United States Patent [19]

Ikeda

[11] 4,266,777

[45] May 12, 1981

[54] TARGET APPARATUS FOR EJECTING ARTICLES

[75] Inventor: Masaki Ikeda, Tokyo, Japan

[73] Assignee: Tomy Kogyo Co., Inc., Tokyo, Japan

[21] Appl. No.: 58,808

[22] Filed: Jul. 19, 1979

Related U.S. Application Data

[62] Division of Ser. No. 875,675, Feb. 6, 1978, Pat. No. 4,212,412.

[30] Foreign Application Priority Data

Feb. 22, 1977 [JP] Japan ..... 52-20680

[51] Int. Cl.[3] ..... F41J 5/02

[52] U.S. Cl. ..... 273/310; 273/354

[58] Field of Search ..... 273/310, 311, 312, , 273/354, 379, 384; 124/32, 48; 221/81

[56] References Cited

U.S. PATENT DOCUMENTS

| | | | |
|---|---|---|---|
| 2,646,786 | 7/1953 | Robertson | 124/48 X |
| 3,376,039 | 4/1968 | Fenton | 273/312 X |

FOREIGN PATENT DOCUMENTS

| | | | |
|---|---|---|---|
| 176867 | 12/1903 | Fed. Rep. of Germany | 124/48 |
| 2707055 | 8/1977 | Fed. Rep. of Germany | 273/310 |

*Primary Examiner*—Anton O. Oechsle

*Attorney, Agent, or Firm*—Edward D. O'Brian

[57] ABSTRACT

A game employing a gun capable of emitting a light beam can be played using a target apparatus which ejects objects each time this apparatus is appropriately actuated by a light beam. The target apparatus includes a turntable which is capable of being rotated by a motor. The turntable includes a plurality of holders, each of which is adapted to hold an object to be ejected from the apparatus. An ejection lever is mounted on the base of the apparatus so as to be capable of ejecting an object from a holder positioned directly above it. After such an object is ejected the motor rotates the turntable. Structures are provided for returning the ejection lever to a position in which it can eject an object from an adjacent holder and for indexing the turntable so that an adjacent holder is above the lever as a result of such rotation of the turntable. A circuit including a photocell is provided on the apparatus for operation of the ejection lever so as to eject an object from a holder positioned above this lever.

5 Claims, 6 Drawing Figures

TARGET APPARATUS FOR EJECTING ARTICLES

CROSS-REFERENCE TO RELATED APPLICATIONS

This application is a division of application Ser. No. 875,675, filed Feb. 6, 1978, now U.S. Pat. No. 4,212,412.

BACKGROUND OF THE INVENTION

The invention set forth in this specification pertains to a new and improved target game employing a target apparatus. More specifically it pertains to a target apparatus as indicated which is constructed so as to propel various objects away from the target apparatus as the target apparatus is actuated during the use of the game.

It will, of course, be recognized that many different types of so-called targets or target apparatuses have been designed and constructed in the past. Such apparatuses have been designed so as to be capable of being actuated by a physical object such as a missile, a ball, a bullet or the like and they have also been designed so as to be actuated by an appropriate beam such as a beam of visible, infrared or other type of radiation. In general such prior targets or target apparatuses may be regarded as either passive or active depending upon whether or not they are constructed so that a mechanical action results from the proper engagement or intended engagement of such a target apparatus by either an object or a type of radiation.

The present invention is primarily concerned with active type target apparatus which provide a significant, easily observed mechanical action in response to the intended manner of target actuation. In essence, the target apparatuses of the present invention may be considered as action-reaction type apparatuses since when they are appropriately actuated such action causes a subsequent physical reaction.

Such active type target apparatuses as have been constructed and utilized in the past are not considered as desirable as reasonably possible for commercial and play purposes for one or more of a variety of related reasons. Such apparatuses have frequently been constructed in such a manner as to be relatively expensive. Frequently they have been designed in such a manner as to be relatively complex from a mechanical standpoint. On occasion such devices are considered to have been unreliable from a mechanical standpoint and to have been constructed in such a manner so as to be relatively incapable of effectively withstanding the physical abuse normally accorded any toy-type structure.

SUMMARY OF THE INVENTION

As a result of these factors it is considered that there is a need for new and improved target games and more specifically target games employing new and improved target apparatuses. A broad objective of the present invention is to fulfill this need. The invention is intended to provide target apparatuses of an active type which are relatively simple to construct at a comparatively nominal cost, which are mechanically comparatively simple, which are capable of withstanding reasonable physical abuse, which are capable of being used over a prolonged period without maintenance difficulty or repair and which are quite desirable because of the action achieved when appropriately actuated. The latter aspect of the invention is considered quite important in connection with the play value of a target apparatus in accordance with this invention.

The noted objectives of the invention are achieved by providing a target game having a target apparatus, the target apparatus including a holding means capable of holding at least one article, ejection means for ejecting the article held by the holding means, target means for controlling the operation of the ejection means so that when the target game is actuated said ejection means is operated so as to cause ejection of an article held by the holding means and actuation means for causing actuation of the target means in which the improvement comprises: the holding means comprising a turntable rotatably mounted on the apparatus, the turntable including a plurality of separate article holders located around its periphery, motive means for rotating the turntable connected to the turntable, the turntable being located relative to the ejection means so that the ejection means is capable of ejecting an article from an adjacent one of the article holders and so that successive of the article holders are located adjacent to the ejection means as a result of the rotation of the turntable, the apparatus including control means for controlling the rotation of the turntable each time the target means is actuated so that successive of the article holders are located adjacent to the ejection means each time the target means is actuated.

A preferred target apparatus in accordance with this invention is preferably constructed so as to include various facets and features which are not indicated in the preceding but which are subsequently indicated in the remainder of this specification and in the accompanying drawings. The portion of such an apparatus involving the turntable and the various associated and related parts of the apparatus are considered to be of such a character as to be capable of being utilized for a variety of different, diverse purposes other than in a specific target game as set forth in this specification.

BRIEF DESCRIPTION OF THE DRAWINGS

The invention is best more fully described with reference to the accompanying drawings in which.

From a careful consideration of the accompanying drawings and the remainder of this specification it will be realized that the precise target apparatus illustrated includes or embodies the principles or features of this invention defined in the appended claims. These same features or principles can easily be embodied within other somewhat differently appearing and/or somewhat differently constructed structures through the use or exercise of routine engineering skill.

DETAILED DESCRIPTION

Figure 6:
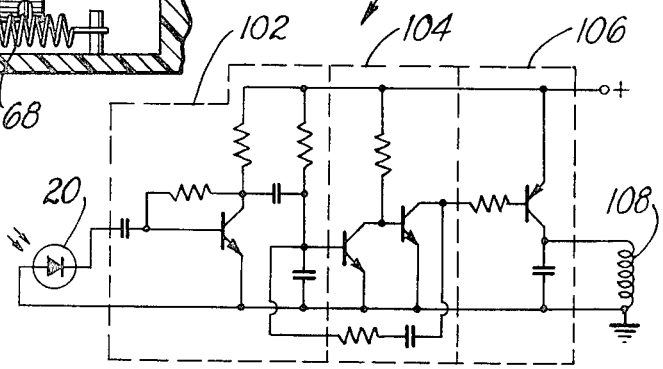
FIG. 6 is a schematic circuit diagram of an electric circuit capable of being utilized in a target apparatus illustrated in the preceding figures.

In the drawings there is shown a target apparatus 10 which is adapted to be utilized with a simulated gun 12 capable of emitting a beam of light as diagrammatically illustrated in FIG. 6. Such an apparatus 10 and gun 12 are considered to constitute a complete target game (not separately numbered) which is adapted to be used as a unit for play purposes. The target apparatus 10 includes an elongated hollow base 14 which is constructed so as to internally hold electric batteries 16, circuit components 18 as are more specifically indicated in connection with FIG. 6, a photocell 20 serving as one of these components and an internal spring motor 22.

This spring motor 22 is attached to an upstanding shaft 24 provided with a keyway type notch 26. This shaft 24 is constructed so that a centrally located hub 28 on a turntable 30 may be located on the shaft 24 with a key or projection 32 on the hub 28 fitting into the notch 26 so as to mechanically couple the turntable 30 with the motor 22 through the shaft 24. The particular motor 22 preferably utilized is a common spring motor which is adapted to be wound when the hub 28 is turned in the direction of the arrow in FIG. 1.

Figure 1:
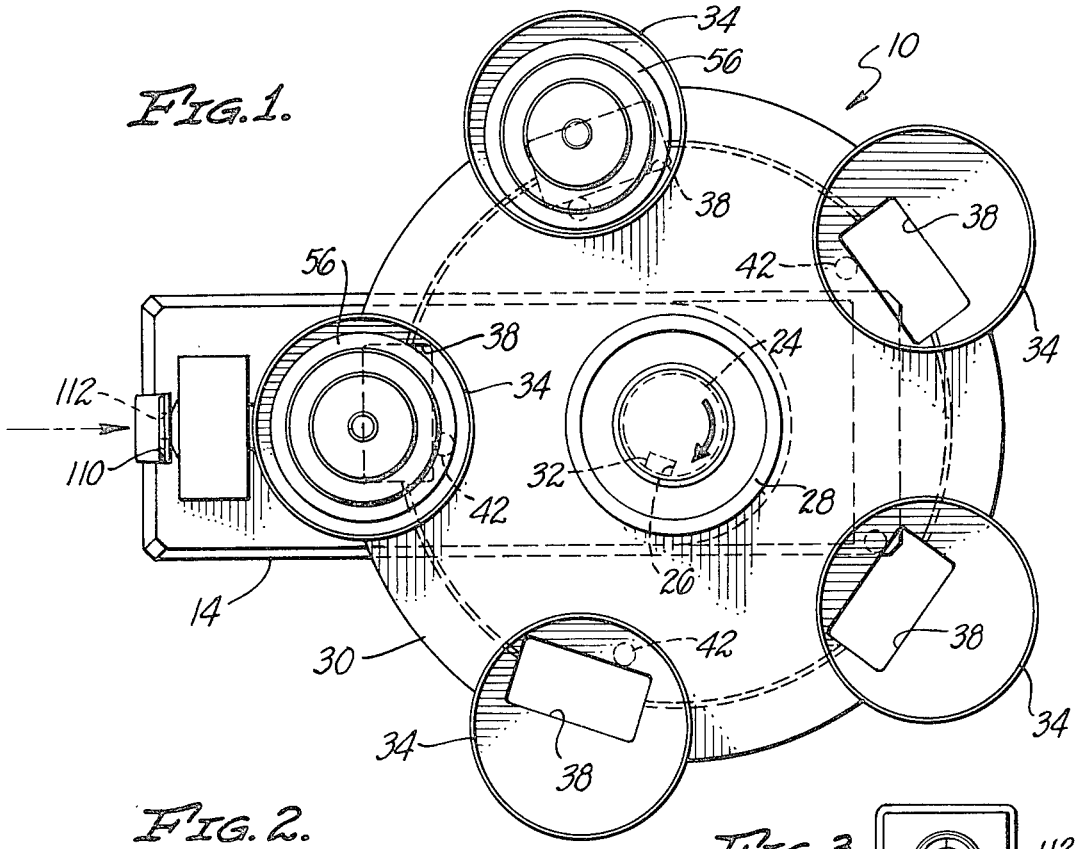
FIG. 1 is a top plan view of a presently preferred embodiment or form of a target apparatus in accordance with this invention in which two articles simulating rockets are located upon article holders forming a part of the target apparatus.
Figure 2:
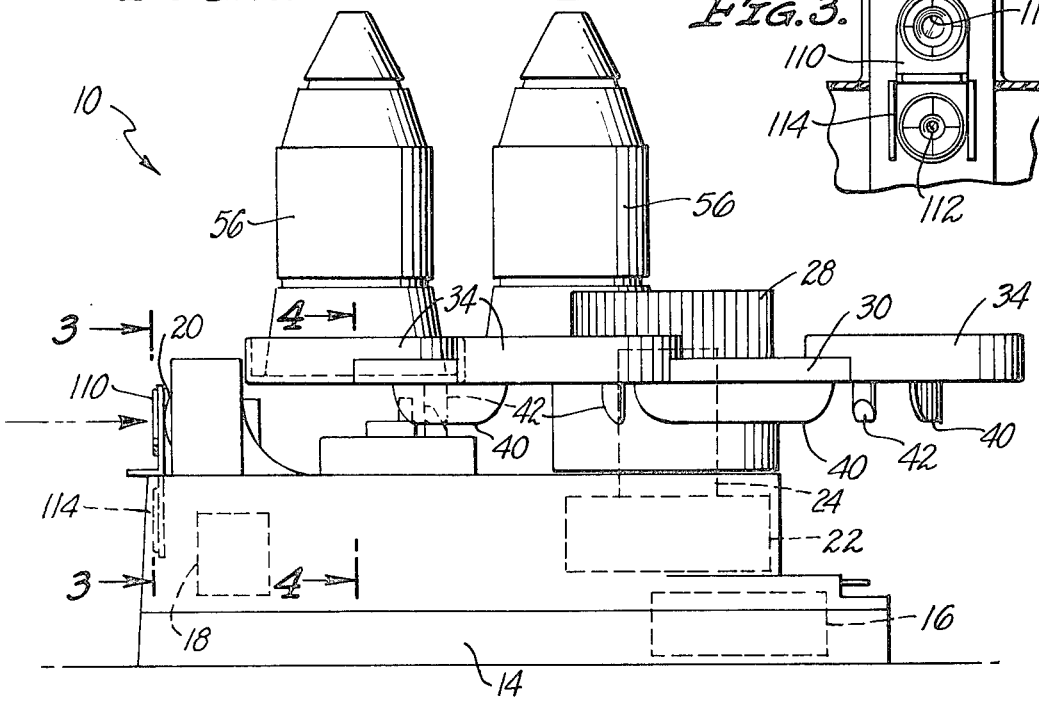
FIG. 2 is a side elevational view of the structure shown in FIG. 1.
Figure 3:
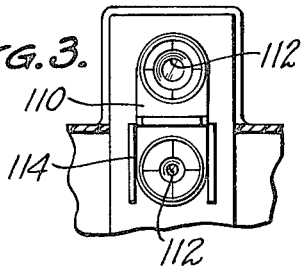
FIG. 3 is a partial cross-sectional view taken at line 3—3 of FIG. 2.

This places the motor 22 in such a condition that it will automatically tend to rotate the turntable 30 in a counter-clockwise direction as viewed in FIG. 1. Such rotation is controlled as hereinafter described so that successive article holders 34 are rotated relative to an ejection lever 36 located generally within the base 14. Each of these article holders 34 is provided with a bottom opening 38 through which the ejection lever 36 can project when in an uncocked position as indicated by phantom lines in FIG. 4. Each of the article holders 34 is associated with both a cocking surface 40 and a stop projection 42 which are located on the turntable 30.

Figure 4:
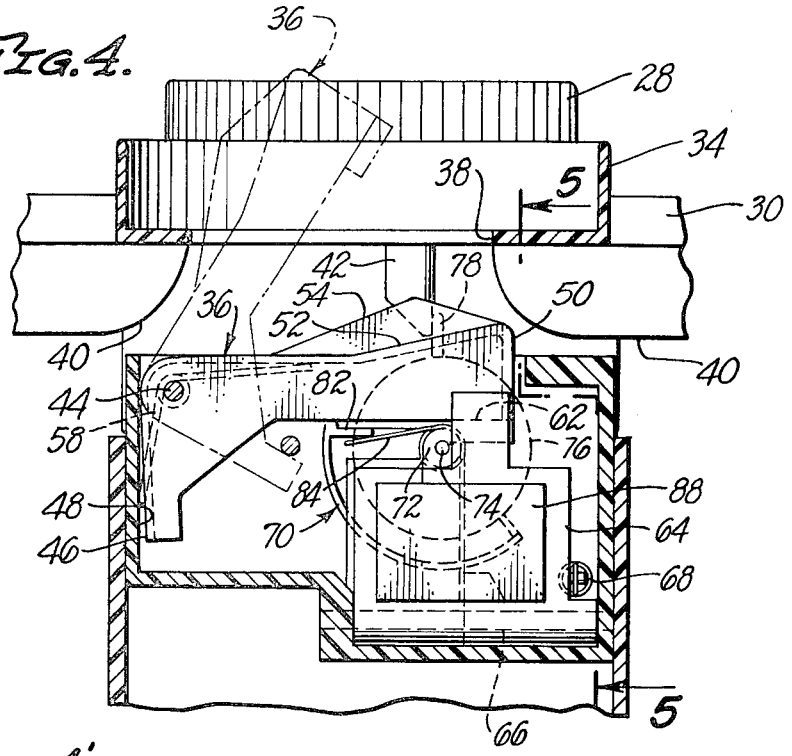
FIG. 4 is a partial cross-sectional view at an enlarged scale taken at line 4—4 of FIG. 2, this view corresponding to a cross-sectional view taken at line 4'—4' in the subsequent FIG. 5.
Figure 5:
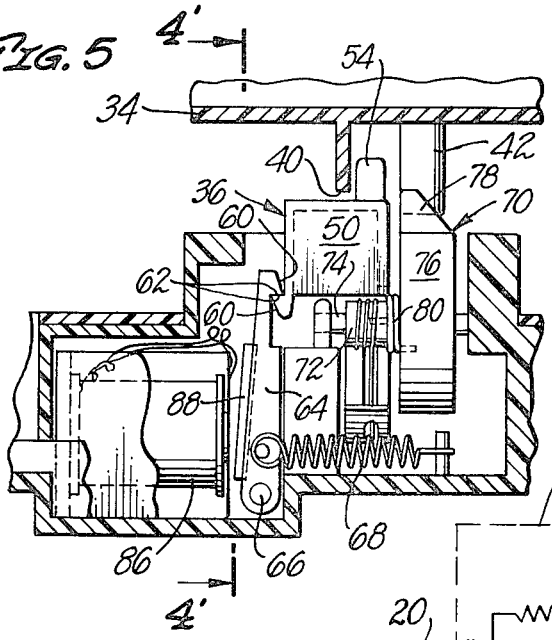
FIG. 5 is a cross-sectional view taken at line 5—5 of FIG. 4.

The ejection lever 36 is rotatably mounted on a small shaft 44 so that it can rotate from a cocked position as shown in FIGS. 4 and 5 to an uncocked position as indicated in the preceding. The ejection lever 36 is of a bell crank shape so that an end 46 of it will rest against an interior wall 48 within the base 14 in order to limit rotation of this lever 36. The other end 50 of the ejection lever 36 is provided with a sloping surface 52 and with a hammer-like projection 54 shaped so as to be capable of engaging and propelling upwardly and outwardly away from the apparatus 10 an article 56 located on a holder 34 immediately above the lever 36. In the drawings only two of such articles 56 are illustrated. Such articles 56 may be shaped so as to simulate space ships or rockets because of the manner in which they are moved during the use of the apparatus 10.

The lever 36 is constructed in the manner indicated so that it will be rotated from the uncocked position identified in the preceding to the cocked position as a result of the surface 52 being engaged by a cocking surface 40 when the motor 22 operates so as to rotate the turntable 30. During such rotation of the turntable 30 this engagement will rotate the ejection lever 36 downwardly against a coil spring 58 located around the shaft 44 so as to place this spring 58 under compression. During such rotation sloping surfaces 60 leading to latch hooks 62 located upon the ejection lever 36 and a latch 64 will slide relative to one another until such time as the hooks 62 are brought into engagement. The latch lever 64 is rotatably mounted upon a shaft 66 and is biased generally toward the ejection lever 36 through the use of a conventional coil spring 68.

Indexing of the turntable 30 so that each time this turntable 30 is turned as a result of the operation of the motor 22 a holder 34 is located adjacent to the lever 36 and is controlled and accomplished through the use of what may be regarded as an escapement lever 70 and through the use of the stop projections 42 illustrated in the preceding. The escapement lever 70 is preferably constructed so as to include a centrally located barrel-like part 72 mounted around a shaft 74 within the base 14. This escapement lever 70 also preferably includes a cylindrical part 76 located around the shaft 74 adjacent the part 72. A projection 78 is located on this part 76. The parts 72 and 76 are coupled together as a unit through the use of a small coil spring 80 so that they normally rotate together as a unit. They are, however, somewhat movable relative to one another so as to prevent damage if for any reason the turntable 30 should be turned in an undesired manner. Normally all of the parts of the escapement lever 70 are biased together as a unit by the spring 80 in such a manner that when a force is applied to a lever arm 82 extending from the part 72 that the lever 70 will be rotated.

The lever arm 82 is held by a spring 84 generally beneath the ejection lever 36 in such a position that each time this ejection lever 36 is moved from an uncocked position to a cocked position the lever arm 82 will be engaged by the ejection lever 36 so as to rotate the entire lever 70 to a position in which the projection 78 will be physically engaged by a stop projection 42. Because of this the projections 42 serve as a part of what in fact is an escapement mechanism used for control purposes. With this structure every time the ejection lever 36 is moved from the cocked position the escapement lever 70 is released to the extent necessary so that it will be rotated as a result of contact with the stop projection 42 by the action of the motor 22 to a sufficient extent so as to permit rotation of the turntable 30. As such rotation occurs the ejection lever 36 will, of course, be returned to its initial cocked position and this will automatically return the escapement lever 70 to a position where it will block further rotation of the turntable 30 and index an article holder 34 relative to the ejection lever 36.

It is believed that it will be apparent from the preceding that in order to remove an article such as the article 56 from a holder 34 and in order to permit a further article 56 to be moved so that it can subsequently be ejected from the next holder 34 it is necessary to appropriately actuate the latch lever 64 in order to release the ejection lever 36. Although this latch lever 64 can be actuated in a variety of ways such as, for example, by direct mechanical contact by an object, it is considered preferable to actuate the latch lever 64 through the use of a solenoid 86. When such a solenoid 86 is used it is, of course, necessary to mount appropriate iron or similar plates 88 on the latch lever 64 so that it will be attached to the solenoid 86.

Although the solenoid 86 may be actuated by virtually any type of desired switch (not shown) it is preferred to utilize a circuit 100 for this purpose as indicated in FIG. 6. Various components of this circuit 100 have been broadly designated as circuit components 18 in the preceding discussion. This circuit 100 includes a conventional pulse amplifier 102, a conventional one-shot multivibrator 104 and a power amplifier 106. The pulse amplifier 102 is connected to the terminals (not separately numbered) of the photocell 20 and the output of the power amplifier 106 is connected to the coil 108 of the solenoid 86. Because the pulse amplifier 102, the one shot multivibrator 104 and the power amplifier 106 are all of a conventional character it is not considered necessary to describe them in detail herein.

This circuit 100 is adapted to be actuated whenever the gun 12 is appropriately actuated so as to project a beam of light (not separately numbered) against the photocell 20. This will, of course, cause the solenoid 86 to be actuated so as to move the latch lever 64 to release the ejection lever 36 in order to achieve the mode of operation indicated in the preceding.

If desired the relative difficulty of actuating the target apparatus 10 in this manner may be varied through the use of an aperture plate 110. This plate 110 is opaque and is provided with two different openings 112 of different sizes. It may be manually positioned within a holder 114 so that either of the openings 112 is located in front of the photocell 20. When the smaller of the openings 112 is in front of the photocell 20 it is obviously more difficult to actuate the circuit 100 than when the larger of the openings 112 is in front of the photocell 20.

I claim:

1. A target game having a target apparatus, said target apparatus including holding means capable of holding at least one article, ejection means for ejecting an article held by said holding means, target means for controlling the operation of said ejection means so that when said target means is actuated said ejection means is operated so as to cause ejection of an article held by said holding means, and actuation means for causing actuation of said target means in which the improvement comprises:

said apparatus including a base, said holding means comprising a turntable rotatably mounted on said base, said turntable including a plurality of separate article holders located around its periphery, motive means for rotating said turntable connected to said turntable, said turntable being located relative to said ejection means so that said ejection means is capable of ejecting an article from an adjacent one of said article holders and so that successive of said article holders are located adjacent to said ejection means as a result of rotation of said turntable, said apparatus including cooperating mechanical escapement means on said turntable and said base responsive to operation of said ejection means to release the turntable for rotation by said motive means and stop said rotation when the next successive article holder is located adjacent to said ejection means.

2. A target game as claimed in claim 1 wherein:

said motive means comprises a spring motor mounted on said base.

3. A target game as claimed in claim 2 wherein:

ejection means is associated with said escapement means so as to control the operation of said escapement means.

4. An apparatus having a base, a turntable located on said base, said turntable including a plurality of article holding locations located around its periphery, motive means for rotating said turntable about its axis, ejection means for removing articles held at said article holding locations from said turntable, and indexing means for controlling movement of said turntable so that successive of said article holding locations are adjacent to said ejection means in which the improvement comprises:

said ejection means comprising an ejection lever pivotally mounted on said base so as to be capable of being rotated between a cocked position in which said ejection lever is spaced from said turntable and an uncocked position in which said lever extends upwardly from said base generally toward said turntable, said ejection lever being capable of engaging an article held at an article holding location on said turntable which is adjacent to said lever when said lever moves from said cocked position to said uncocked position, biasing means biasing said lever toward said uncocked position, a cocking surface corresponding to each of said article holding locations located on said turntable, said cocking surfaces being located so as to be capable of sequentially engaging said ejection lever when said turntable is rotated and when said ejection lever is in said uncocked position so as to rotate said ejection lever from said uncocked position to said cocked position, latch means for holding said ejection lever in said cocked position, latch release means for moving said latch means so as to permit said biasing means to move said ejection lever from said cocked position to said uncocked position, said indexing means comprising an escapement lever and a plurality of stop projections, each of said stop projections corresponding to one of said article holding locations located on said turntable, said escapement lever pivotally mounted on said base, said escapement lever being capable of being rotated between a blocking position and a non-blocking position, said escapement lever being located so as to engage one of said stop means in order to limit rotation of said turntable in said blocking position, said escapement lever being located so as not to interfere with the rotation of said turntable in said non-blocking position, said escapement lever being located so as to be engaged by said ejection lever as said ejection lever is moved from said uncocked to said cocked position so as to be rotated to said blocking position, target means for actuating said apparatus, said target means being operatively connected to said latch release means.

5. An apparatus having a base, a turntable located on said base, said turntable including a plurality of article holding locations located around its periphery, motive means for rotating said turntable about its axis, ejection means for removing articles held at said article holding locations from said turntable, and indexing means for controlling movement of said turntable so that successive of said article holding locations are adjacent to said ejection means in which the improvement comprises:

said ejection means comprising an ejection lever pivotally mounted on said base so as to be capable of being rotated between a cocked position in which said ejection lever is spaced from said turntable and an uncocked position in which said lever extends upwardly from said base generally toward said turntable, said ejection lever being capable of engaging an article held at an article holding location on said turntable which is adjacent to said lever when said lever moves from said cocked position to said uncocked position, biasing means biasing said lever toward said uncocked position, a cocking surface corresponding to each of said article holding locations located on said turntable, said cocking surfaces being located so as to be capable of sequentially engaging said ejection lever when said turntable is rotated and when said ejection lever is in said uncocked position so as to rotate said ejection lever from said uncocked position to said cocked position, latch means for holding said ejection lever in said cocked position, latch release means for moving said latch means so as to permit said biasing means to move said ejection lever from said cocked position to said uncocked position, said apparatus including cooperating mechanical escapement means on said turntable and said base responsive to operation of said ejection means to release the turntable for rotation by said motive means and stop said rotation when the next successive article holder is located adjacent to said ejection means, target means for actuating said apparatus, said target means being operatively connected to said latch release means.

* * * * *